US006966503B1

(12) United States Patent
Chen

(10) Patent No.: US 6,966,503 B1
(45) Date of Patent: Nov. 22, 2005

(54) SPRINKLER PROVIDED WITH A BUILT-IN MECHANISM FOR DISPENSING DETERGENT

(75) Inventor: Chin-Yuan Chen, Chang-Hua Hsien (TW)

(73) Assignee: Shin Tai Spurt Water of the Garden Tools Co., Ltd., Changhua Hsien (TW)

( * ) Notice: Subject to any disclaimer, the term of this patent is extended or adjusted under 35 U.S.C. 154(b) by 112 days.

(21) Appl. No.: 10/753,287

(22) Filed: Jan. 9, 2004

(51) Int. Cl.[7] ..... A62C 5/02; B05B 7/26

(52) U.S. Cl. ..... 239/310; 239/373; 137/205.5; 137/564.5; 222/144.5

(58) Field of Search ..... 239/530, 310, 239/373; 137/268, 564.5, 205.5; 222/144, 222/144.5, 145.5, 145.7

(56) References Cited

U.S. PATENT DOCUMENTS 2,671,691 A * 3/1954 Schnell ..... 137/564.5
2,717,403 A * 9/1955 Batlas et al. ..... 15/29
2,797,132 A * 6/1957 Alpert ..... 137/584
2,908,445 A * 10/1959 Schwartz ..... 239/317
4,281,796 A * 8/1981 Fugent et al. ..... 239/310
5,988,911 A * 11/1999 Browne, Jr. et al. ..... 401/42
6,164,496 A * 12/2000 Gregory ..... 222/144.5
6,572,032 B2 * 6/2003 Chih ..... 329/375
6,726,123 B2 * 4/2004 Wang ..... 239/310
2002/0079381 A1 * 6/2002 Smith et al. ..... 239/310
2003/0052193 A1 * 3/2003 Shanklin et al. ..... 239/318

* cited by examiner

*Primary Examiner*—Carl S. Miller
(74) *Attorney, Agent, or Firm*—Alan D. Kamrath; Nikolai & Mersereau, P.A.

(57) ABSTRACT

A sprinkler includes a shunt, a water-control shaft, a switch and a detergent storage pipe, wherein the shunt is provided with axial hole vertically connected to radial notch. Both sides of this shunt are vertically equipped with diversion holes. The top ends and bases of both diversion holes are separately connected to radial notch; the rotatable water-control shaft is linked to the radial notch of shunt. The middle section of the rod is provided with a concave main notch and a water panel. Both sides of main notch are equipped with two secondary notches. The radial positions of secondary notches are staggered, of which opposite internal edges of secondary notches are connected to main notch.

4 Claims, 5 Drawing Sheets

SPRINKLER PROVIDED WITH A BUILT-IN MECHANISM FOR DISPENSING DETERGENT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a sprinkler, and more particularly to a sprinkler which is provided with a built-in mechanism for dispensing detergent.

BACKGROUND OF THE INVENTION

The present invention is a modified sprinkler. The difference between the modified and conventional sprinklers lies in that the former one has a rod-shaped configuration whereby the distance between handle and sprinkler head can be enlarged, so it can be applied to spray farther objects. In addition to its applications for conventional horticulture, this sprinkler is often applied to cleaning purposes. However, there are also some disadvantages. As this sprinkler can only spray water owing to its structural design, detergent is required where applicable. That is to say, independent work for the detergent is expected, leading to a lower performance. Thus, it is necessary to make some breakthrough innovations for more convenient applications of such sprinkler.

Therefore, based upon aforementioned disadvantages of the conventional sprinkler, this industry assumes the responsibility to make efforts to develop a utility model, which is able to mix detergent rapidly during control of discharge and offer a more convenient and effective application.

BRIEF SUMMARY OF THE INVENTION

1. To provide an innovative sprinkler that is composed of a shunt, a water-control shaft, a switch and a detergent storage pipe. This is a preferred option of this industry in conformity with the requirements of a new patent.

2. Based upon this modified structural design, the end-users can rotate the switch to activate the water-control shaft, and have optional modes of supplying either water or mixed detergent via the variable angles/positions of main notch and secondary notch, thereby improving the performance of such sprinkler to serve major purposes.

DETAILED DESCRIPTION OF THE INVENTION

Figure 1:
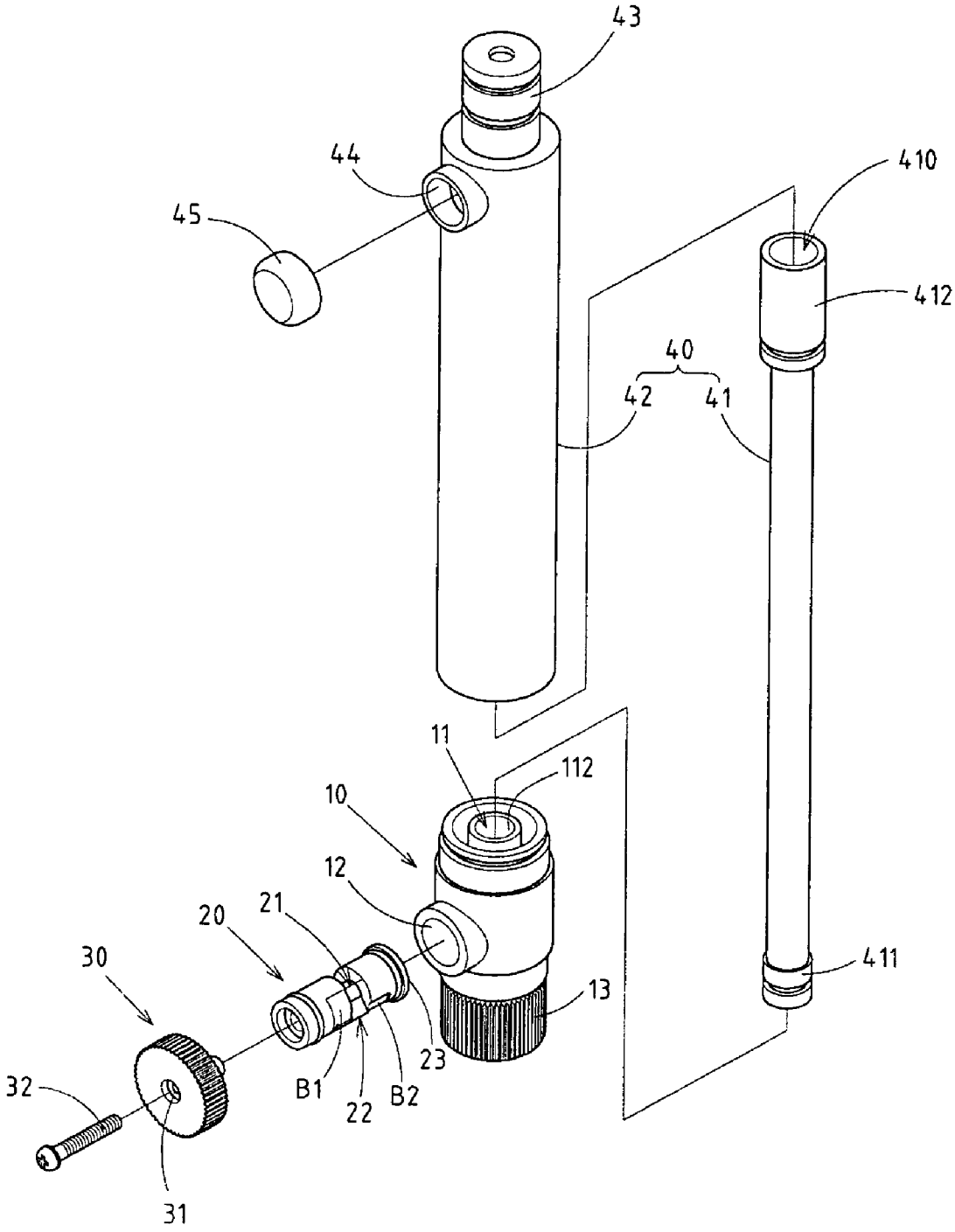
FIG. 1 shows a perspective view of the preferred embodiment of the present invention.
Figure 2:
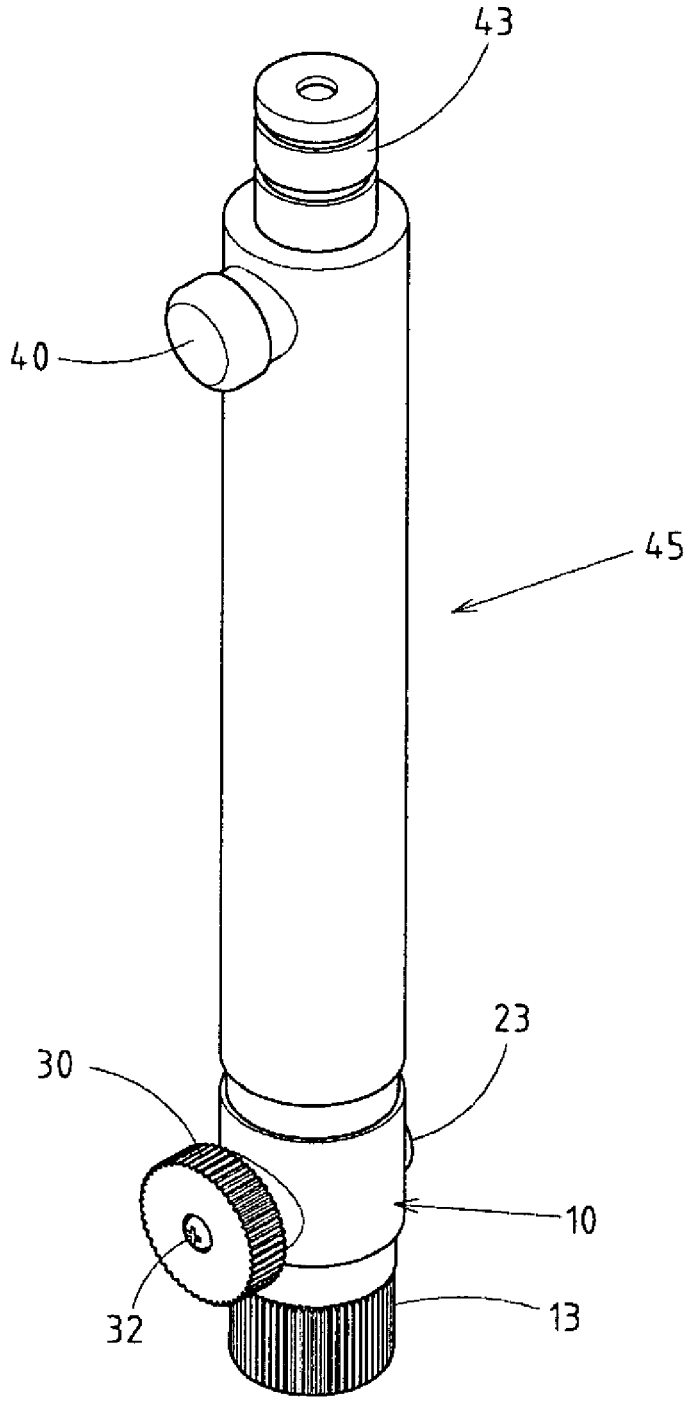
FIG. 2 shows an exploded perspective view of a detergent dispensing mechanism of the present invention.

The features and the advantages of the present invention will be more readily understood upon a thoughtful deliberation of the following detailed description of a preferred embodiment of the present invention with reference to the accompanying drawings.

Firstly, refer to the modified examples of sprinkler with built-in mechanism for dispensing detergent, as shown in FIGS. 1–4.

The sprinkler includes a shunt 10 of a cylinder type with an axial hole 11 at the center. The middle section of shunt 10 is provided with a radial notch 12 connected vertically to above-mentioned axial hole 11. The base of shunt 10 is equipped with a pipe connector 13 to link existing aqueduct connector. The top center of shunt 10 is provided with a horizontal notch 112 at the outlet of axial hole 11. Both sides of this shunt 10 are vertically equipped with diversion hole A1 and diversion hole A2. The bases of both diversion holes are vertically connected to radial notch 12.

Figure 5:
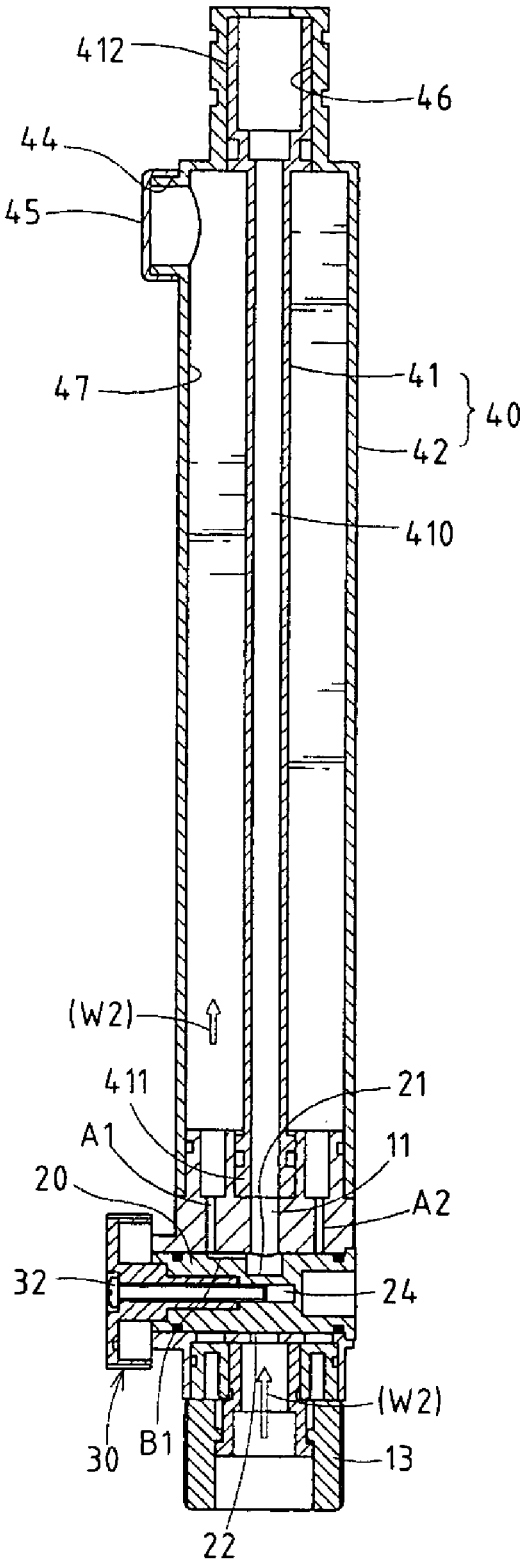
FIG. 5 shows a cross-sectional view of the connected state of secondary notch and diversion hole of the present invention.
Figure 7:
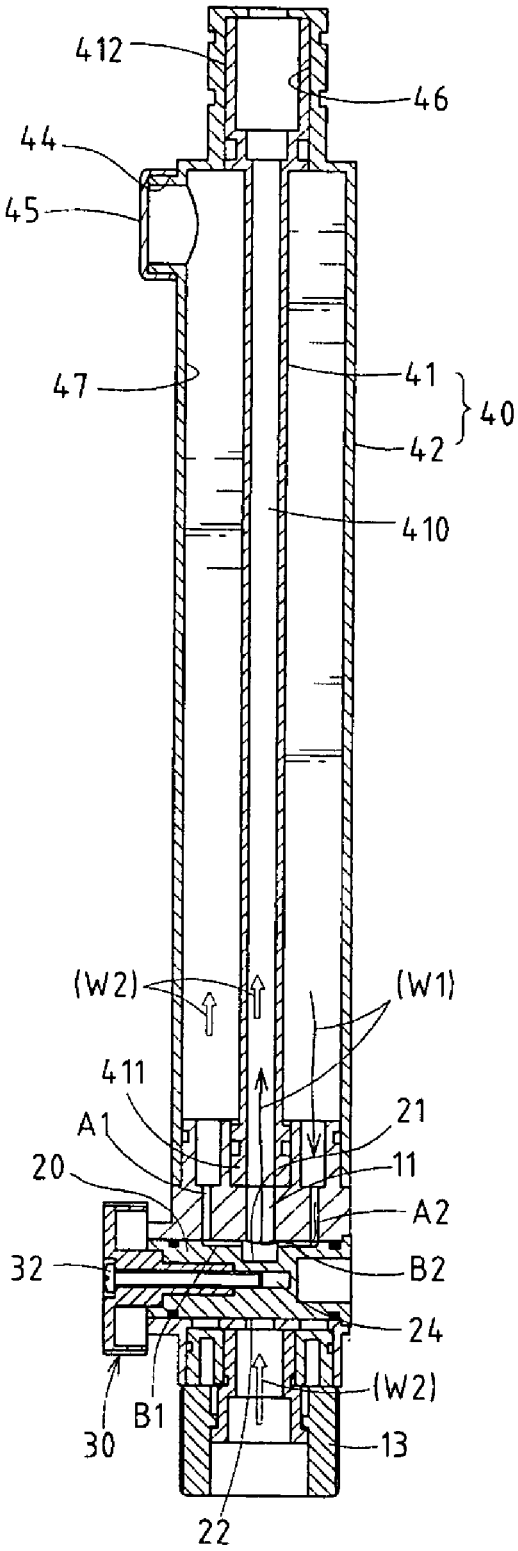
FIG. 7 shows another cross-sectional view of the connected state of secondary notch and diversion hole of the present invention.

The sprinkler also has a water-control shaft 20 of a round rod shape with a rotatable radial notch 12 of shunt 10. The middle section of the rod is provided with a concave main notch 21 with its width larger than the radius of the rod, as well as an opposite water panel 22. Both of the axial sides of main notch 21 are equipped with a secondary notch B1 and a secondary notch B2. The radial positions of secondary notches B1 B2 are staggered for misalignment of which opposite internal edges of secondary notches B1 B2 are connected to main notch 21. Along with the rotation of water-control shaft 20, the radial side of secondary notch B1 will be firstly connected to diversion hole A1 (as shown in FIG. 5). Then the radial side of secondary notch B2 will be connected to diversion hole A2 (as shown in FIG. 7).

The sprinkler further includes a switch 30 provided at one side of water-control shaft 20 and exposed to the surface of shunt 10. The end-user can hold it to rotate water-control shaft 20.

There is also a detergent storage pipe 40 provided at the top of shunt 10 and composed of an internal pipe 41 a pipe case 42. The base of the pipe case 42 is attached to the top of shunt 10 while the top of pipe case 42 is provided with a reducing linkage member 43 for the connection of preset sprinkler head fittings. The inlet of detergent 44 is reserved at the top of one side of pipe case 42 and capable of providing a hood 45 to avoid the leakage of detergent W1. The base 411 of the internal pipe 41 is inserted into the horizontal notch 112 at the top of shunt 10 while the top 412 of the internal pipe 41 is inserted into the linkage member 43 of pipe case 42 to form a notch hole 46. The base of internal pipe 41's orifice 410 is connected to the axial hole 11 of shunt 10 while the top of internal pipe 41's orifice 410 runs upwards until the top of linkage member 43 of pipe case 42 so as to form an outflow tube. Based upon the compartment between internal pipe 41 and pipe case 42, a circular detergent tank 47 can be shaped. Moreover, the base of the detergent tank 47 is connected to the diversion hole A1, A2 of shunt 10.

Figure 3:
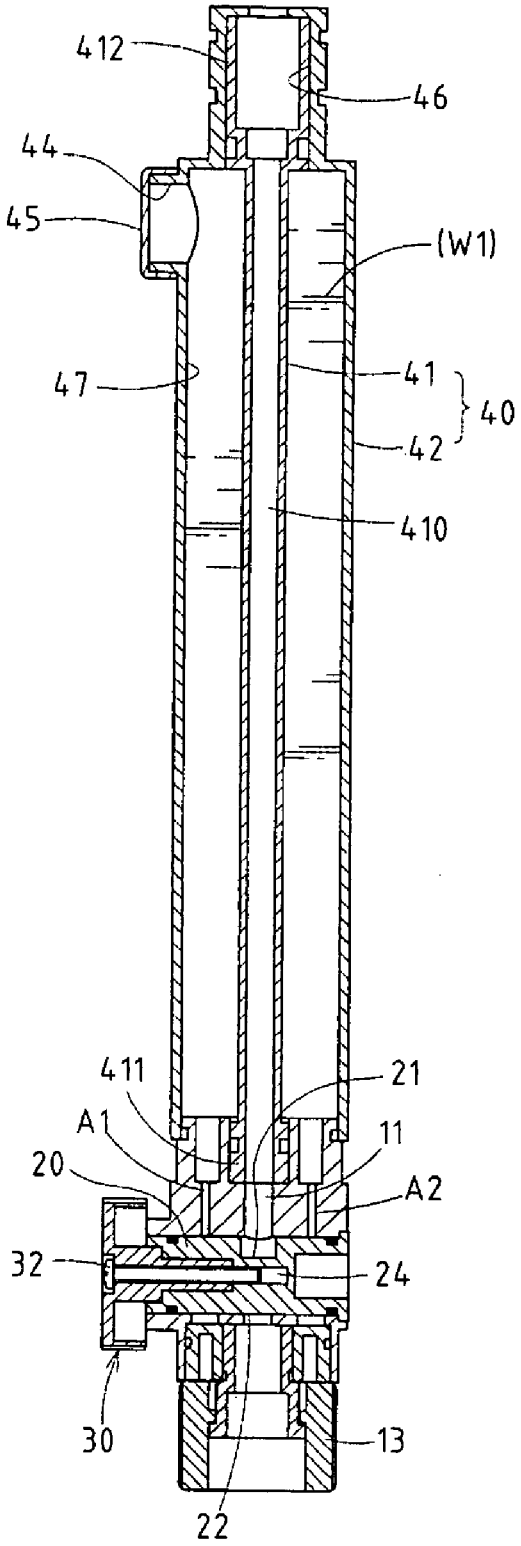
FIG. 3 shows a cross-sectional view of the closing state of waterflow of the present invention.

The sprinkler of the present invention includes a convex ring edge 23 formed at one side of water-control shaft 20 far away from the switch 30, so as to provide a notch edge 121 at the opposite side of shunt 10's radial notch 12 as shown in FIG. 3 and insert spacer by the convex ring edge 23. A screw hole 24 is provided at one side of water-control shaft 20 so as to place a punching hole 31 at the center of switch 30. A screw bolt 32 is applied to cross through the punching hole 31 of the switch 30, and then fastened to the screw hole 24 of water-control shaft 20. At the same time, it is capable of assembling and positioning the switch 30 and water-control shaft 20 as shown in FIG. 3.

Moreover, the pipe case 42 of the detergent storage pipe is constructed of transparent materials, so as to enable the end-users to observe clearly internal residual detergent W1.

Based upon the structure and composition as above specified, the present invention makes a detailed description as follows.

Figure 4:
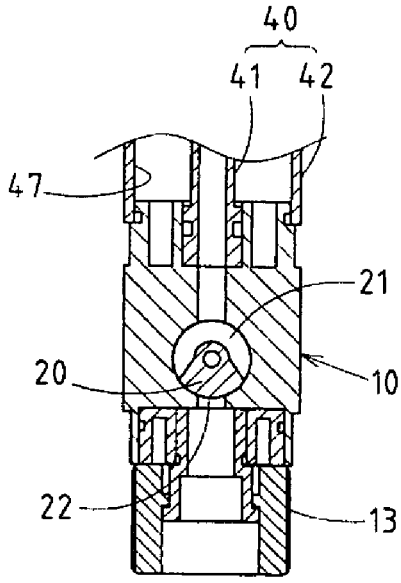
FIG. 4 shows a cross-sectional view of the closing state of waterflow of the present invention from another angle.

As shown in FIGS. 3–4, the water-control shaft 20 is in a watertight state. In such case, the main notch 21 at middle section of the rod faces upwards and the water panel 22 faces downwards to form an axial hole 11, thus preventing upward waterflow.

Figure 6:
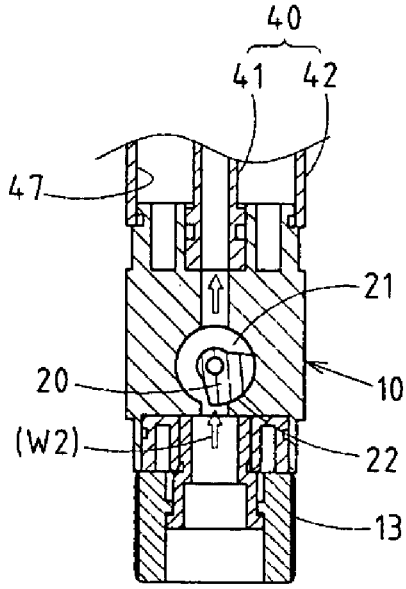
FIG. 6 shows the cross-sectional view as of FIG. 5 from another angle.

As shown in FIGS. 5–6, when the end-user rotates the switch 30 and simultaneously activate the water-control shaft 20 to rotate towards the preset direction of opening, the main notch 21 will firstly register the axial hole 11 and let the water W2 flow through pipe connector 13 for discharge. At the same time, the radial end of secondary notch B1 is connected to the diversion hole A1, for the internal side of the secondary notch B1 is linked to the main notch 21, thus the pressure of water W2 will fill into detergent tank 47 along secondary notch B1 and diversion hole A1 to serve the purpose of yielding pre-compression upon internal detergent W1.

Figure 8:
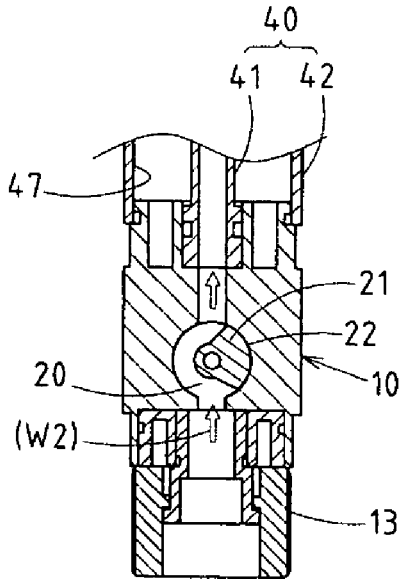
FIG. 8 shows the cross-sectional view as of FIG. 7 from another angle.

As shown in FIGS. 7–8, when the end-user continues to rotate the switch 30, the radial side of secondary notch B2 is connected to the diversion hole A2, for the internal side of the secondary notch B2 is also linked to main notch 21, and the diversion hole A2 linked to detergent tank 47. In such case, the detergent W1 within detergent tank 47 is subjected to the pre-compression of upper sections, the accumulated pressure will force the detergent W1 to flow through diversion hole A2, secondary notch B2, main notch 21, axial hole 11 and orifice 410 of internal pipe 41, thus forming a waterflow mode of mixed detergent W1. Based upon the fact that the constant register waterflow of diversion hole A1 and secondary notch B1 is more than that of diversion hole A2 and secondary notch B2, the detergent W1 within detergent tank 47 is continuously forced out by water W2, then mixed and deconcentrated gradually.

What is claimed is:

1. A sprinkler comprising:

a shunt of a cylinder type with an axial hole at the center, a middle section of the shunt having a radial notch connected vertically to said axial hole, a base of the shunt having a pipe connector to link an existing aqueduct connector; wherein both sides of the shunt are vertically equipped with two diversion holes, bases of both diversion holes being vertically connected to the radial notch;

a water-control shaft of a round rod shape with a rotatable radial notch of shunt a middle section of the shaft having a concave main notch with a width larger than the radius of the shaft and a water panel, wherein both radial sides of the main notch have two secondary notches, radial positions of secondary notches being staggered for misalignment of which opposite internal edges of secondary notches are connected to main notch; wherein, along with rotation of the shaft, wherein the radial side of a first secondary notch is firstly connected to a diversion hole and the radial side of secondary notch is connected to another diversion hole;

a switch provided at one side of water-control shaft and exposed to the surface of shunt; and a detergent storage pipe provided at the top of the shunt and comprised of an internal pipe and a pipe case, a base of the pipe case being attached to the top of the shunt while a top of the pipe case is provided with a reducing linkage member for connection of preset sprinkler head fittings; wherein an inlet of detergent is reserved at the top of one side of the pipe case and the case provides a hood to avoid leakage of the detergent; wherein an internal pipe is provided at the center of the pipe case, and the base of a pipe orifice is connected to the axial hole of the shunt while the top of the pipe orifice runs upwards until the top of the linkage member of the pipe case so as to form an outflow tube; and wherein said detergent dispensing mechanism comprises a circular detergent tank, the base of the detergent tank being connected to the diversion holes.

2. The sprinkler as defined in claim 1, wherein said internal pipe and pipe case are constructed separately, so as to form a concave notch hole within the linkage member of pipe case; wherein a top center of the shunt is provided with a horizontal notch at the outlet of the axial hole such that the top end and base of the internal pipe is capable of inserting separately into the above-mentioned notch hole and horizontal notch.

3. The sprinkler as defined in claim 1, wherein said convex ring edge is formed at one side of water-control shaft far away from the switch, so as to provide a notch edge at the opposite side of shunt's radial notch and insert spacer by the convex ring edge; wherein a screw hole is provided at one side of water-control shaft so as to place a punching hole at the center of switch; and wherein a screw bolt is applied to cross through the punching hole of the switch, and then fastened to the screw hole of water-control shaft, said screw bolt assembling and positioning the switch and water-control shaft.

4. The sprinkler as defined in claim 1, wherein said pipe case of the detergent storage pipe is comprised of transparent materials, so as to enable the end-users to observe clearly internal residual detergent.

* * * * *